US007228917B2

(12) United States Patent
Davis et al.

(10) Patent No.: US 7,228,917 B2
(45) Date of Patent: Jun. 12, 2007

(54) REMOTE TRIGGER ACTUATING MECHANISM FOR POWER TOOL

(75) Inventors: George Matthew Davis, Chicago, IL (US); David W. Jablonski, Warrenville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 25 days.

(21) Appl. No.: 11/232,640

(22) Filed: Sep. 22, 2005

(65) Prior Publication Data

US 2007/0074882 A1 Apr. 5, 2007

(51) Int. Cl.
*B27C 3/08* (2006.01)

(52) U.S. Cl. ..... 173/170; 173/29; 30/296.1; 16/114.1; 16/426; 294/19.1

(58) Field of Classification Search ..... 173/170, 173/171, 29, 30; 227/10, 156; 16/421, 430, 16/114.1, 426; 30/296.1, 198; 81/487; 294/19.1
See application file for complete search history.

(56) References Cited

U.S. PATENT DOCUMENTS 2,643,088 A 6/1953 Hornack
2,730,803 A 1/1956 Kimball
3,060,769 A * 10/1962 Heider ..... 408/95
3,086,574 A 4/1963 Ustin
3,229,859 A * 1/1966 Conroy et al. ..... 222/174
3,272,267 A 9/1966 Langas
3,485,206 A * 12/1969 Smrt ..... 118/305
3,805,385 A 4/1974 Ritums et al.
3,930,604 A * 1/1976 Pitkin et al. ..... 227/8
3,949,817 A 4/1976 Rice
3,985,188 A 10/1976 Steele
4,147,220 A 4/1979 Swiderski, Jr. et al.
4,284,223 A * 8/1981 Salcido et al. ..... 227/5
4,359,822 A 11/1982 Kolodziejczyk (Continued)

OTHER PUBLICATIONS

"Powers Fasteners Trak-IT Gas Fastening System—Trak-IT Pole Tool brochure".

*Primary Examiner*—Scott A. Smith
(74) *Attorney, Agent, or Firm*—Schwartz & Weinrieb

(57) ABSTRACT

A new and improved remote trigger actuating mechanism for a power tool comprises an elongated handle or pole which is provided with a handgrip upon a rear end portion, while a mounting bracket, into which a forward end portion of the elongated handle or pole is fixedly engaged, is fixedly mounted upon a rear end portion of the power tool as a result of being bolted directly thereto by suitable bolt fasteners. A spring-biased sleeve member is concentrically disposed about the elongated handle or pole, and a trigger actuator linkage member has a rear end portion thereof fixedly mounted upon the spring-biased sleeve member while a forward end portion of the trigger actuator linkage member is provided with a hooked portion which is adapted to engage the trigger mechanism of the power tool. The spring-biased sleeve member is normally biased to a forward extended position by a coil spring such that the trigger actuator linkage member does not normally engage the trigger mechanism of the power tool, however, when the spring-biased sleeve member is manually moved in the rearward direction against the spring-biasing force of the coil spring, the trigger actuator or linkage member will engage and actuate the trigger mechanism of the power tool whereby the power tool will be energized.

20 Claims, 3 Drawing Sheets

U.S. PATENT DOCUMENTS 4,479,599 A * 10/1984 Conrad ..... 227/9
4,707,921 A 11/1987 Meyer et al.
4,736,804 A * 4/1988 Geibel ..... 173/30
4,996,773 A * 3/1991 Albertson ..... 30/121
5,135,388 A * 8/1992 Pettit ..... 431/254
5,295,620 A 3/1994 Cousineau et al.
5,361,851 A 11/1994 Fox
5,411,238 A 5/1995 Caron
5,463,918 A * 11/1995 Lemieux et al. ..... 81/487
5,509,489 A 4/1996 Lower, Jr.
5,546,749 A 8/1996 Couchee
5,598,892 A 2/1997 Fox
5,787,536 A 8/1998 Pate
5,787,590 A 8/1998 D'Alessandro, Sr.
5,926,913 A 7/1999 Hernandez et al.
6,021,854 A 2/2000 Scarola
6,357,809 B1 * 3/2002 Gregoire, Sr. ..... 294/19.1
6,488,511 B1 * 12/2002 Stewart ..... 439/32
6,918,185 B2 7/2005 Barger

* cited by examiner

REMOTE TRIGGER ACTUATING MECHANISM FOR POWER TOOL

FIELD OF THE INVENTION

The present invention relates generally to power tools, and more particularly to a new and improved remote trigger actuating mechanism which is to be utilized in conjunction with a power tool so as to enable the trigger mechanism of the power tool to be actuated from a position which is remote from the location at which the power tool will be performing work upon a workpiece, such as, for example, the driving of a fastener into the workpiece, whereby the power tool operator is able to remotely actuate the power tool as is sometimes necessary.

BACKGROUND OF THE INVENTION

Oftentimes, it is desirable to remotely actuate a power tool in connection with the performance of work upon a particular workpiece at a particular work site or location. One instance in which the remote actuation of a power tool may be desirable would comprise the driving or fixation of fasteners into workpieces which may be located in an overhead position, such as, for example, the fixation of ceiling panels or the like to ceiling substructures. Conventionally, it would usually be necessary for a workman to use a ladder or scaffolding structure in order to permit the workman to be located at an elevated position whereby the workman could advantageously position the power tool at a position adjacent to the ceiling substructure into which suitable fasteners would be driven in order to in fact fixedly secure the ceiling panels to the ceiling substructure. The construction of suitable scaffolding, however, is quite time consuming, and in addition, it is cumbersome and difficult to move the scaffolding from one region or section of a room within which the ceiling panels are being installed.

Similarly, in connection with the use of a ladder, the workman must likewise position the ladder at a first location at which, for example, a first ceiling panel is to be affixed to the ceiling substructure, the workman must then climb up the ladder so as to advantageously position himself at a particularly desirable location in order to in fact affix the first one of the ceiling panels to the ceiling substructure, the workman must then climb down the ladder, move the ladder to a second location at which a second ceiling panel is to be affixed to the ceiling substructure, and the entire process necessarily repeated numerous times until all of the ceiling panels are in fact affixed to the ceiling substructure. Obviously, such an installation procedure or process is quite tiring and time-consuming. A second instance in which the remote actuation of a power tool may be desirable would comprise the driving or fixation of fasteners into work pieces which may be positioned at relatively inaccessible locations.

It would therefore be desirable to have a device which would effectively enable the power tool to be actuated from a position which is remote from the location at which the power tool is to be used to drive or install fasteners within a workpiece which is located, for example, at an elevated or relatively inaccessible position. For example, if such a remotely-actuated device existed, the workman could effectively actuate the power tool, so as to install, for example, the ceiling tiles onto the ceiling substructure, while the workman was standing on the floor or ground. An example of such a device for remotely actuating a power tool, such as, for example, a rivet gun for driving rivet type fasteners into a ceiling substructure in order to affix ceiling panels onto the ceiling substructure, is disclosed within U.S. Pat. No. 3,985,188 which issued to Steele on Oct. 12, 1976. More particularly, as can be appreciated from FIG. 1, which substantially corresponds to FIG. 1 of the drawings of the patent to Steele, it is seen that the remote control device or tool extension comprises an extension pole which is generally indicated by the reference character 10. The extension pole 10 is seen to comprise a handle 12 which has a plate member 14 mounted upon the upper end portion thereof, and a yoke 16 is pivotally connected to an upper end portion of the plate member 14 as at 18. An intermediate portion of the yoke 16 is also pivotally connected to the oppositely disposed sides 22 of a cradle 23 as at 21, and it is seen that the cradle 23 is adapted to house or accommodate the power tool 24. The power tool 24 is secured within the cradle 23 by means of a clamping strap or ring 28 which is provided with a locking mechanism 30, and it is seen that the nozzle 24*a* of the power tool 24, from which the rivet fasteners are to be discharged, is oriented vertically upwardly such that a workpiece contacting element 24*b* may be depressed into contact with the ceiling C. The lower end portion of the cradle 23 is also mounted in a spring-biased manner upon the plate member 14 through means of a coil spring 32, and a release mechanism 45 is disposed within the coil spring housing for actuation by means of a cable, not shown, which is operatively connected to a finger actuator 38 which projects outwardly through a slot 36 formed within a side wall portion of the handle 12. When the finger actuator 38 is moved so as to, in turn, actuate the release mechanism 45, the handle 12 and plate member 14 are able to be moved upwardly so as to cause the pivoting of the yoke 16 with respect to the cradle 23 whereby the bight portion of the yoke 16 will operatively engage and actuate the trigger mechanism T of the power tool 24.

While the aforenoted remote actuation device of Steele is substantially satisfactory from an operational point of view, it is noted that the remote actuation device of Steele does embody several operational disadvantages or drawbacks. For example, it is firstly noted that in order to remotely actuate the power tool 24 of Steele by means of the extension device, the extension device necessarily comprises the provision of the specially configured cradle 23 in order to hold and mount the power tool in a stabilized manner. In addition, in view of the fact that the trigger mechanism T can only be actuated when the finger actuator 38 is actuated prior to the actuation of the trigger mechanism T, and in view of the additional fact that the finger actuator 38 projects outwardly through the slot 36 defined within a predetermined side wall portion of the extension pole 10 and handle 12, then the finger actuator 38 is only accessible from angular positions present within a predetermined angular region defined around the longitudinal axis of the extension pole 10 and the handle 12. Accordingly, the angular orientation of the extension pole 10 and handle 12, or spatial limitations of the locale within which the power tool 24 is to be used, may limit access to the finger actuator 38.

A need therefore exists in the art for a new and improved remote trigger actuating mechanism for a power tool wherein the remote trigger actuating mechanism can be mounted directly upon the power tool by means of existing fastening means such that supplemental or auxiliary means, such as, for example, a cradle, is not required to hold or mount the tool in a stabilized manner, and in addition, the trigger mechanism of the power tool can be actuated by means of the remote trigger actuating mechanism which may be operated from any angular position disposed within the complete range of 360° encompassing the longitudinal axis of the elongated handle.

SUMMARY OF THE INVENTION

The foregoing and other objectives are achieved in accordance with the teachings and principles of the present invention through the provision of a new and improved remote trigger actuating mechanism for a power tool wherein the remote trigger actuating mechanism comprises an elongated handle or pole which is provided with a handgrip upon a proximal or rear end portion thereof, while a mounting bracket, which is fixedly mounted upon an externally threaded distal or forward end portion of the elongated handle or pole, is adapted to be fixedly mounted upon a rear end portion of the power tool as a result of being bolted directly thereto by means of suitable bolt fasteners. In addition, a spring-biased sleeve member is concentrically disposed about the elongated handle or pole, and a trigger actuator or linkage member has a proximal or rear end portion thereof fixedly mounted upon the spring-biased sleeve member while a distal or forward end portion of the trigger actuator or linkage member is provided with a hooked portion which is adapted to engage the trigger mechanism of the power tool.

The spring-biased sleeve member is normally biased to a forward extended position by means of a coil spring, which is interposed between a rear end portion of the sleeve member and a flange member disposed upon a rear end portion of the elongated handle or pole, such that the trigger actuator or linkage member does not normally engage the trigger mechanism of the power tool, however, when the spring-biased sleeve member is manually moved by means of an operator in the rearward direction against the spring-biasing force of the coil spring, the trigger actuator or linkage member will engage and actuate the trigger mechanism of the power tool whereby the power tool will be activated or energized. Accordingly, it can be appreciated that a specially configured cradle or the like is not required to effectively mount the power tool upon the new and improved remote trigger actuating mechanism, that the new and improved remote trigger actuating mechanism can be directly mounted upon the power tool by means of existing fastener components, and in view of the fact that both the handgrip and the sleeve member can be accessed or grasped throughout a 360° angular expanse, the new and improved remote trigger actuating mechanism can be conveniently operated regardless of angular orientation or spatial limitations.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
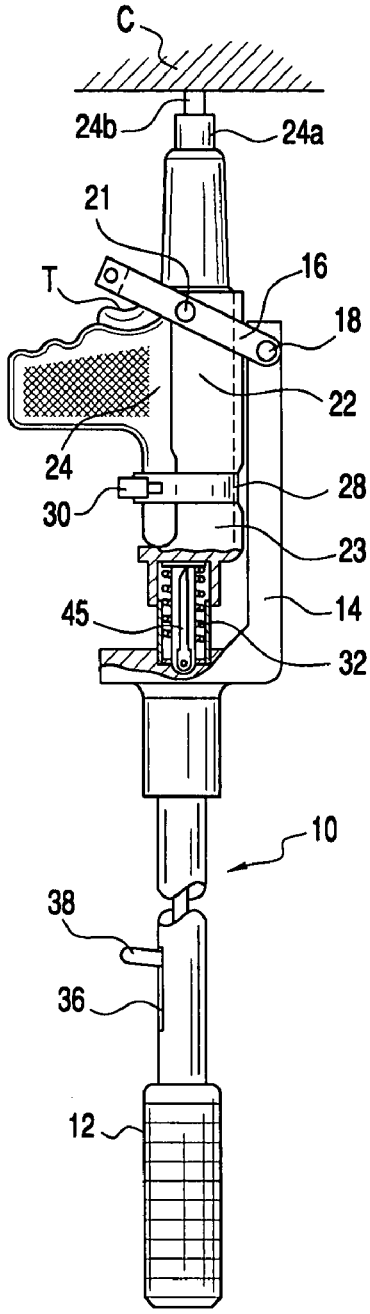
FIG. 1 (PRIOR ART)
FIG. 1 is a side elevational view of a conventional, PRIOR ART extension attachment device for a power tool wherein the power tool is mounted within a cradle implement of the extension attachment device and is actuated by means of a finger actuator mechanism.
Figure 2:
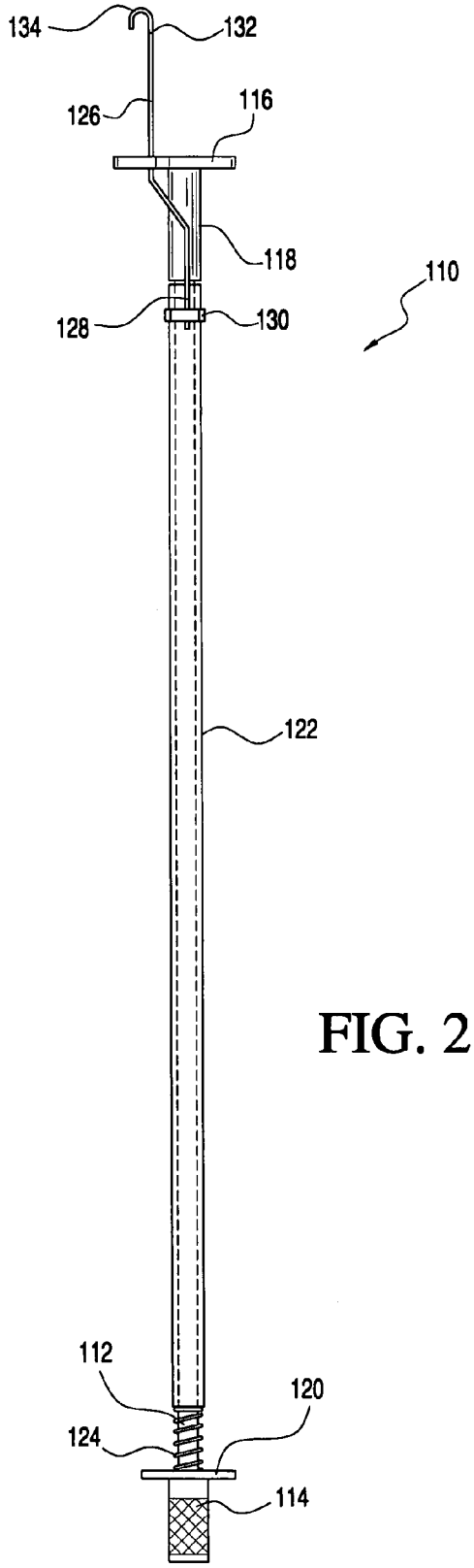
FIG. 2 is a side elevational view of a first embodiment of a new and improved remote trigger actuating mechanism for a power tool as constructed in accordance with the principles and teachings of the present invention and showing the operative parts thereof.

Referring now to the drawings, and more particularly to FIG. 2 thereof, a first embodiment of a new and improved remote trigger actuating mechanism for a power tool is disclosed and is generally indicated by the reference character 110. More particularly, it is seen that, in accordance with the principles and teachings of the present invention, the new and improved remote trigger actuating mechanism comprises an elongated handle or pole 112 wherein a handgrip 114 is integrally formed or fixedly mounted upon a proximal or lower, rear end portion of the elongated handle or pole 112, while a mounting bracket 116 is effectively fixedly mounted upon a distal or upper, forward end portion of the elongated handle or pole 112. The elongated handle or pole 112 is preferably fabricated from a suitable, relatively light-weight material, such as, for example, FIBERGLASS® or the like, and an annular collar 118 is adapted to be fixedly mounted upon the distal or upper, forward end portion of the elongated handle or pole 112 in a concentric manner by suitable means, such as, for example, suitable screw fasteners, set screws, an adhesive bonding material, or the like. The annular collar 118 is provided with an externally threaded upper or forward end portion, not illustrated, which is adapted to be threadedly mated within an internally threaded bore, also not shown, which is formed within the mounting bracket 116, and in this manner, the mounting bracket 116, as a result of being fixedly mounted upon the collar 118, is effectively fixedly mounted upon the distal or upper, forward end portion of the elongated handle or pole 112. As will be discussed more fully hereinafter, the mounting bracket 116 is adapted to be fixedly mounted upon a rear end portion of the power tool as a result of being bolted directly thereto by means of a plurality of bolt fasteners. The bolt fasteners will be respectively threadedly inserted into a plurality of internally threaded bores which are already pre-existing upon the power tool in that a plurality of bolt fasteners are normally used to fixedly secure a plastic cap member upon the rear end portion of the power tool, wherein the plastic cap member normally accommodates or houses an air filter assembly for the power tool.

Continuing further, and in accordance with further unique and novel features characteristic of the present invention, a flanged member 120 is fixedly formed or mounted upon the elongated handle or pole 112 so as to be located just forwardly of, or above, the handgrip 114, and an annular sleeve member 122 is concentrically disposed upon the elongated handle or pole 112 so as to envelop the same. It is seen that the annular sleeve member 122 is disposed upon the elongated handle or pole 112 so as to be interposed between the lower or rear end portion of the annular collar 118 and the upper or forward-facing surface portion of the flanged member 120, and it is further seen that the longitudinal or axial extent of the annular sleeve member 122 is less than that of the elongated handle or pole 112 such that the annular sleeve member 122 is capable of movement along and with respect to the elongated handle or pole 112 in the axial or longitudinal direction. A coiled spring 124 is interposed between the lower or rear end portion of the annular sleeve member 122 and the upper or forward-facing surface portion of the flanged member 120, and in this manner, the annular sleeve member 122 is normally spring-biased in the upward or forward direction such that the upper or forward end portion of the annular sleeve member 122 is normally disposed in contact with the annular collar 118. However, as will become more apparent hereinafter, the annular sleeve member 122 will be able to be moved in the downward or rearward direction away from the annular collar 118 and the mounting bracket 116, against the spring-bias of the coiled spring 124, when the trigger mechanism of the power tool is to be actuated.

With reference still being made to FIG. 2, it is further seen that in order to in fact achieve the remote actuation of the trigger mechanism of the power tool in accordance with the principles and teachings of the present invention, a trigger actuator 126 is mounted upon the distal or forward end portion of the elongated handle or pole 112. More particularly, it is seen that the trigger actuator 126 comprises a substantially elongated linkage member wherein a rearward portion 128 of the trigger actuator 126 is fixedly secured upon an upper or forward end portion of the annular sleeve member 122 by means of a suitable clamp mechanism 130, while a forward end portion 132 of the trigger actuator 126 is provided with a hooked portion 134 which is adapted to engage the trigger mechanism of the power tool. It is to lastly be appreciated that a central portion 136 of the trigger actuator 126 passes through the mounting bracket 116, and accordingly, the mounting bracket 116 will be provided with a suitable radially oriented slot or through-hole, both not illustrated, so as to in fact permit the central portion of the trigger actuator 126 to pass therethrough in a slidably or longitudinally movable manner. As a result of the passage of the central portion 136 of the trigger actuator 126 through the mounting bracket 116, the elongated trigger actuator 126 is substantially confined to movement in the longitudinal or axial direction.

It is of course to be further appreciated that when the annular sleeve member 122 is disposed in its forwardmost position under the biasing influence of the coiled spring 124, the hooked portion 134 of the trigger actuator 126 will effectively be disengaged from the trigger mechanism of the power tool whereby the power tool will not be actuated, however, when the power tool is to be actuated, the operator will, for example, grasp the handgrip 114 with one hand, and grasp the annular sleeve member 122 with the other hand so as to be capable of manually moving the annular sleeve member 122 to the rearward or lowered position, against the biasing force of the coiled spring 124. In this manner, the hooked portion 134 of the trigger actuator 126 will be engaged with the trigger mechanism of the power tool so as to in fact actuate the power tool. It is therefore to be appreciated that unlike the actuation system of Steele, the annular sleeve member 122 may be grasped, and therefore actuated, from any angular position within a complete 360° field of operation such that the actuation of the remote trigger actuating mechanism 110 is not at all restricted due to angular orientation or positioning of the remote trigger actuating mechanism 110, or alternatively, due to spatial limitations.

Figure 3:
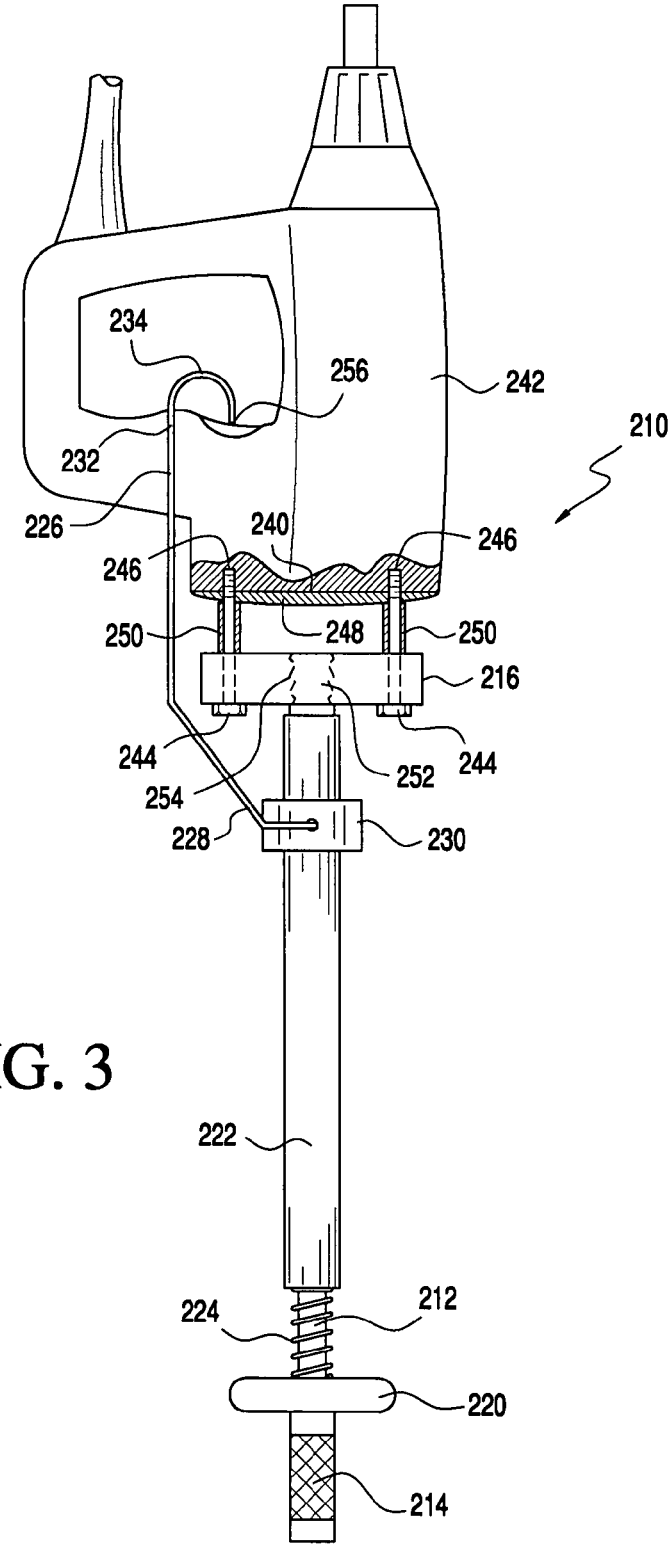
FIG. 3 is a side elevational view of a second embodiment of a new and improved remote trigger actuating mechanism, similar to that illustrated within FIG. 2, wherein the new and improved remote trigger actuating mechanism is illustrated as being fixedly mounted directly upon the power tool by means of the mounting bracket and existing fastener components.

With reference now being made to FIG. 3, a second embodiment of a new and improved remote trigger actuating mechanism for a power tool is disclosed and is generally indicated by the reference character 210. It is to be noted that component parts of the second embodiment remote trigger actuating mechanism 210, which correspond to the component parts of the first embodiment remote trigger actuating mechanism 110, will be designated by similar reference characters except for the fact that the reference characters will be within the 200 series. In addition, only those structural features of the second embodiment remote trigger actuating mechanism 210 which differ from the structural features of the first embodiment remote trigger actuating mechanism 110 will be discussed in detail in the interest of brevity. More particularly, it is seen, for example, that in accordance with the principles and teachings of the second embodiment remote trigger actuating mechanism 210 of the present invention, the mounting bracket 216 is fixedly mounted upon the rear end wall or surface portion 240 of a power tool 242 by means of a plurality of bolt fasteners 244 which are respectively threadedly engaged within internally threaded bores 246. The internally threaded bores 246 are pre-existing upon the power tool 242 in view of the fact that bolt fasteners, not shown but shorter than the bolt fasteners 244, are conventionally used to mount a cap assembly 248, which conventionally includes an air filter assembly for the power tool 242, upon the rear end wall or surface portion 240 of the power tool 242. Accordingly, in order to affix the mounting bracket 216 upon the rear end wall or surface portion 240 of a power tool 242, the conventional fasteners, not shown, are merely replaced by means of the longer bolt fasteners 244 so as to accommodate the mounting bracket 216, the cap assembly 248, and a plurality of spacers 250 which are provided so as to space the mounting bracket from the air filter assembly, not shown, incorporated within the power tool cap assembly 248. The externally threaded shaft section of elongated pole or handle 212 is disclosed at 252, while the internally threaded bore defined within the mounting bracket 216 is disclosed at 254. It is lastly to be appreciated that in lieu of the trigger actuator 226 passing through the mounting bracket 216, as was the case of the trigger actuator 126 with respect to the mounting bracket 116 of the first embodiment remote trigger actuating mechanism 110, it is seen that the trigger actuator 226 extends entirely externally around the mounting bracket 216. The trigger mechanism of the power tool 242 is also disclosed at 256.

Thus, it may be seen that in accordance with the principles and teachings of the present invention, there has been disclosed a new and improved remote trigger actuating mechanism for a power tool wherein the remote trigger actuating mechanism comprises an elongated handle or pole which is provided with a handgrip upon a proximal or rear end portion thereof, while a mounting bracket, which is fixedly mounted upon an externally threaded distal or forward end portion of the elongated handle or pole, is adapted to be fixedly mounted upon a rear end portion of the power tool as a result of being bolted directly thereto by means of suitable bolt fasteners which are threadedly engaged within pre-existing threaded bores already formed within the power tool. In addition, a spring-biased sleeve member is concentrically disposed about the elongated handle or pole, and a trigger actuator or linkage member has a proximal or rear end portion thereof fixedly mounted upon the spring-biased sleeve member while a distal or forward end portion of the trigger actuator or linkage member is provided with a hooked portion which is adapted to engage the trigger mechanism of the power tool.

The spring-biased sleeve member is normally biased to a forward extended position by means of a coil spring, which is interposed between a rear end portion of the sleeve member and a flange member disposed upon a rear end portion of the elongated handle or pole, such that the trigger actuator or linkage member does not normally engage the trigger mechanism of the power tool, however, when the spring-biased sleeve member is manually moved by means of an operator in the rear-ward direction against the spring-biasing force of the coil spring, the trigger actuator or linkage member will engage and actuate the trigger mechanism of the power tool whereby the power tool will be activated or energized. Accordingly, it can be appreciated that a specially configured cradle or the like is not required to effectively mount the power tool upon the new and improved remote trigger actuating mechanism, that the new and improved remote trigger actuating mechanism can be directly mounted upon the power tool by means of existing fastener components, and in view of the fact that both the handgrip and the sleeve member can be accessed or grasped throughout a 360° angular expanse, the new and improved remote trigger actuating mechanism can be conveniently operated regardless of angular orientation or spatial limitations.

Obviously, many variations and modifications of the present invention are possible in light of the above teachings. For example, while two embodiments of the new and improved remote trigger actuating mechanism have been disclosed, wherein the elongated handle or pole may have a predetermined length dimension, such as, for example, six feet, with a corresponding smaller length dimension for the enveloping annular sleeve member, both the elongated handle or pole and the annular sleeve member may be formed from or comprise additional sections which may be fixedly mated together so as to respectively provide the elongated handle or pole and the annular sleeve member with selective overall length dimensions so as to be adaptive to particular on-site installation needs. It is therefore to be understood that within the scope of the appended claims, the present invention may be practiced otherwise than as specifically described herein.

What is claimed as new and desired to be protected by Letters Patent of the United States of America, is:

1. A remote trigger actuating mechanism for a power tool, comprising:

a mounting bracket;

means for fixedly securing said mounting bracket upon the power tool;

an elongated handle fixedly secured upon said mounting bracket;

a sleeve member disposed substantially concentric-ally around said elongated handle for relative movement with respect to said elongated handle between a forward position and a rearward position; and a linkage member having a rearward end portion fixedly mounted upon said sleeve member and a forward end portion adapted to engage a trigger mechanism of the power tool wherein when said sleeve member is disposed at one of said forward and rearward positions, said forward end portion of said linkage member will be disengaged from the trigger mechanism of the power tool so as not to actuate the power tool, whereas when said sleeve member is disposed at another one of said forward and rearward positions, said forward end portion of said linkage member will be engaged with the trigger mechanism of the power tool so as to actuate the power tool.

2. The remote trigger actuating mechanism as set forth in claim 1, wherein:

said sleeve member is movably mounted upon said elongated handle for relative movement with respect to said elongated handle between said forward position and said rear-ward position such that when said sleeve member is disposed at said forward position, said forward end portion of said linkage member will be disengaged from the trigger mechanism of the power tool so as not to actuate the power tool, and when said sleeve member is disposed at said rearward position, said forward end portion of said linkage member will be engaged with the trigger mechanism of the power tool so as to actuate the power tool.

3. The remote trigger actuating mechanism as set forth in claim 2, further comprising:

spring-biasing means for normally biasing said sleeve member to said forward position.

4. The remote trigger actuating mechanism as set forth in claim 3, further comprising:

a handgrip integrally formed upon a rearward portion of said elongated handle for being grasped by one hand of an operator while the other hand of the operator can grasp said sleeve member whereby said sleeve member can be moved against the biasing force of said spring-biasing means.

5. The remote trigger actuating mechanism as set forth in claim 4, wherein:

said spring-biasing means comprises a coiled spring interposed between said handgrip and a rearward portion of said sleeve member.

6. The remote trigger actuating mechanism as set forth in claim 1, further comprising:

spring-biasing means for normally biasing said sleeve member to said forward position.

7. The remote trigger actuating mechanism as set forth in claim 6, further comprising:

a handgrip integrally formed upon a rearward portion of said elongated handle for being grasped by one hand of an operator while the other hand of the operator can grasp said sleeve member whereby said sleeve member can be moved against the biasing force of said spring-biasing means.

8. The remote trigger actuating mechanism as set forth in claim 7, wherein:

said spring-biasing means comprises a coiled spring interposed between said handgrip and a rearward portion of said sleeve member.

9. The remote trigger actuating mechanism as set forth in claim 1, wherein:

a central portion of said linkage member passes through said mounting bracket.

10. The remote trigger actuating mechanism as set forth in claim 1, wherein:

said linkage member is disposed entirely externally of said mounting bracket.

11. The remote trigger actuating mechanism as set forth in claim 1, wherein:

said sleeve member comprises an annular sleeve member which can be grasped and actuated through means of a 360° angular expanse.

12. In combination, a remote trigger actuating mechanism for a power tool, comprising:

a power tool;

a mounting bracket;

means for fixedly securing said mounting bracket upon said power tool;

an elongated handle fixedly secured upon said mounting bracket;

a sleeve member disposed substantially concentric-ally around said elongated handle for relative movement with respect to said elongated handle between a forward position and a rearward position; and a linkage member having a rearward end portion fixedly mounted upon said sleeve member and a forward end portion adapted to engage a trigger mechanism of said power tool wherein when said sleeve member is disposed at one of said forward and rearward positions, said forward end portion of said linkage member will be disengaged from said trigger mechanism of said power tool so as not to actuate said power tool, whereas when said sleeve member is disposed at another one of said forward and rearward positions, said forward end portion of said linkage member will be engaged with said trigger mechanism of said power tool so as to actuate said power tool.

13. The combination as set forth in claim 12, wherein:

said sleeve member is movably mounted upon said elongated handle for relative movement with respect to said elongated handle between said forward position and said rear-ward position such that when said sleeve member is disposed at said forward position, said forward end portion of said linkage member will be disengaged from said trigger mechanism of said power tool so as not to actuate said power tool, and when said sleeve member is disposed at said rearward position, said forward end portion of said linkage member will be engaged with said trigger mechanism of said power tool so as to actuate said power tool.

14. The combination as set forth in claim 13, further comprising:

spring-biasing means for normally biasing said sleeve member to said forward position.

15. The combination as set forth in claim 14, further comprising:

a handgrip integrally formed upon a rearward portion of said elongated handle for being grasped by one hand of an operator while the other hand of the operator can grasp said sleeve member whereby said sleeve member can be moved against the biasing force of said spring-biasing means.

16. The combination as set forth in claim 15, wherein:

said spring-biasing means comprises a coiled spring interposed between said handgrip and a rearward portion of said sleeve member.

17. The combination as set forth in claim 12, further comprising:

spring-biasing means for normally biasing said sleeve member to said forward position.

18. The combination as set forth in claim 17, further comprising:

a handgrip integrally formed upon a rearward portion of said elongated handle for being grasped by one hand of an operator while the other hand of the operator can grasp said sleeve member whereby said sleeve member can be moved against the biasing force of said spring-biasing means.

19. The combination as set forth in claim 18, wherein:

said spring-biasing means comprises a coiled spring interposed between said handgrip and a rearward portion of said sleeve member.

20. The combination as set forth in claim 12, wherein:

said sleeve member comprises an annular sleeve member which can be grasped and actuated through means of a 360° angular expanse.

* * * * *